US011607579B2

(12) United States Patent
Elpers

(10) Patent No.: US 11,607,579 B2
(45) Date of Patent: Mar. 21, 2023

(54) FITNESS SLIDER

(71) Applicant: Philip John Elpers, Evansville, IN (US)

(72) Inventor: Philip John Elpers, Evansville, IN (US)

( * ) Notice: Subject to any disclaimer, the term of this patent is extended or adjusted under 35 U.S.C. 154(b) by 0 days.

(21) Appl. No.: 17/460,242

(22) Filed: Aug. 29, 2021

(65) Prior Publication Data

US 2022/0184453 A1 Jun. 16, 2022

Related U.S. Application Data

(60) Provisional application No. 63/125,495, filed on Dec. 15, 2020.

(51) Int. Cl.

| | |
|---|---|
| ***A63B 21/00*** | (2006.01) |
| ***A63B 23/04*** | (2006.01) |
| ***A63B 21/06*** | (2006.01) |
| ***A63B 21/068*** | (2006.01) |

(52) U.S. Cl.

CPC ..... *A63B 21/4034* (2015.10); *A63B 21/0004* (2013.01); *A63B 21/068* (2013.01); *A63B 21/0618* (2013.01); *A63B 21/4035* (2015.10); *A63B 23/047* (2013.01)

(58) Field of Classification Search

CPC ..... A63B 21/4034; A63B 21/0004; A63B 21/0618; A63B 21/068; A63B 21/4035; A63B 23/047

See application file for complete search history.

(56) References Cited

U.S. PATENT DOCUMENTS

| | | | | |
|---|---|---|---|---|
| 4,134,584 | A | 1/1979 | Rosenbusch | |
| 8,702,574 | B2 | 4/2014 | Abranchess | |
| 8,858,405 | B2 | 10/2014 | Agate | |
| 9,011,294 | B2 | 4/2015 | Mylrea et al. | |
| 9,358,419 | B1 | 6/2016 | Smith | |
| 10,398,930 | B2 | 9/2019 | Chessen et al. | |
| 2006/0229173 | A1 | 10/2006 | Foley | |
| 2011/0224050 | A1 | 9/2011 | Larish | |
| 2011/0224051 | A1* | 9/2011 | Larish | A63B 21/0618 482/93 |
| 2014/0162849 | A1* | 6/2014 | Engle, Jr. | A63B 21/06 482/110 |
| 2015/0335938 | A1 | 11/2015 | Seen et al. | |
| 2017/0326402 | A1 | 11/2017 | Sorin et al. | |
| 2020/0238127 | A1* | 7/2020 | Wehrell | A63B 21/40 |
| 2021/0339070 | A1* | 11/2021 | Bartley | A63B 21/151 |

OTHER PUBLICATIONS

International Search Report and Written Opinion corresponding to International Patent Application No. PCT/US2021/072872, dated Apr. 28, 2022 (13 pages).

* cited by examiner

*Primary Examiner* — Andrew S Lo
(74) *Attorney, Agent, or Firm* — Maginot, Moore & Beck, LLP

(57) ABSTRACT

A fitness slider is provided that is capable of holding a weight plate during use, to be manipulated by one or more extremities using the weight plate as the engagement surface for the user's hand or foot. Another fitness slider is configured to mate with different sizes of weight plates. Yet another fitness slider is provided that includes a handle on top of the weight plate as the engagement surface.

19 Claims, 20 Drawing Sheets

FITNESS SLIDER

CROSS-REFERENCE TO RELATED APPLICATION

This application is a utility filing from and claims priority to U.S. Provisional Application No. 63/125,495, filed on Dec. 15, 2020, and entitled "Weighted Fitness Slider", the entire disclosure of which is incorporated herein by reference.

FIELD OF THE INVENTION

This disclosure relates to exercise equipment and particularly to weight bearing equipment for sliding on a surface.

BACKGROUND

Certain exercises rely on a "sled" or a "slider" that are propelled across a surface, such as a floor, by the person. Sleds are configured for stacking weights and then pulling or pushing the sled in a certain direction. Sleds are intended for bulk training, such as for football linemen, and are not intended for or capable of finesse and micro-movement exercises. Fitness sliders or gliders are discs configured to slide across the floor and provide the ability to do single extremity omni-directional agility and finesse exercises. Current gliders/sliders primarily serve as a low-friction surface for moving a person's arms or legs across a floor or carpet. For instance, in an alternating leg curl, the user extends his/her leg with the foot seated on a glider so that the foot can move more freely than if it was sliding on the floor or carpet. Similarly, the burpee can be performed with the feet planted on gliders so that the feet slide across the floor instead of jumping the legs backwards, as in a traditional burpee. Other tuck and lunge exercises, as well as some push-up exercises, can benefit from the use of a glider to reduce the sliding friction between the user's feet and hands and the floor or carpet. However, current gliders or sliders lack the ability to provide meaningful resistance to the sliding movement, and in fact the principal purpose of conventional gliders/sliders is to reduce the resistance.

There is a need for an exercise device that combines the weight-carrying features of a sled and the sliding features of a glider/slider. The exercise device would combine the omnidirectional and finesse abilities of the fitness slider and the resistance customizability of the weight sled.

SUMMARY OF THE DISCLOSURE

It is one object of the present invention to provide an alternative to fitness sliders by allowing the user to add resistance and to safely increase workout effectiveness. According to the present disclosure, a fitness slider is provided that is capable of holding a weight plate during use, to be manipulated by one or more extremities using the weight plate as the engagement surface for the user's hand or foot. In another aspect, a fitness slider is provided that includes a handle on top of the weight plate as the engagement surface.

Thus, according to one embodiment, a fitness slider includes a sliding plate having a low-friction sliding surface on one side and the opposite side of the sliding plate configured to support a weight plate therein. A center hub projects from the opposite side of the sliding plate that is sized and configured to be received within the center opening of the weight plate when the weight plate is supported on the sliding plate.

According to another embodiment, a fitness slider includes a sliding plate having a low-friction sliding surface on one side of the sliding plate and the opposite side of the sliding plate configured to support a weight plate therein. The sliding plate includes a plurality of engagement wedges projecting from the opposite side of the sliding plate, with the plurality engagement wedges sized and arranged to extend through the center opening of the weight plate when the weight plate is supported on said sliding plate. A removable handle is provided that is configured for engagement by the hand or foot of a user. The handle includes a like plurality of engagement wedges projecting from the handle that are also sized and arranged to extend through the center opening of the weight plate. The two sets of engagement wedges interdigitate within the center opening of the weight plate when the handle is mounted on the sliding plate, sandwiching the weight plate therebetween.

DETAILED DESCRIPTION

Figure 1:
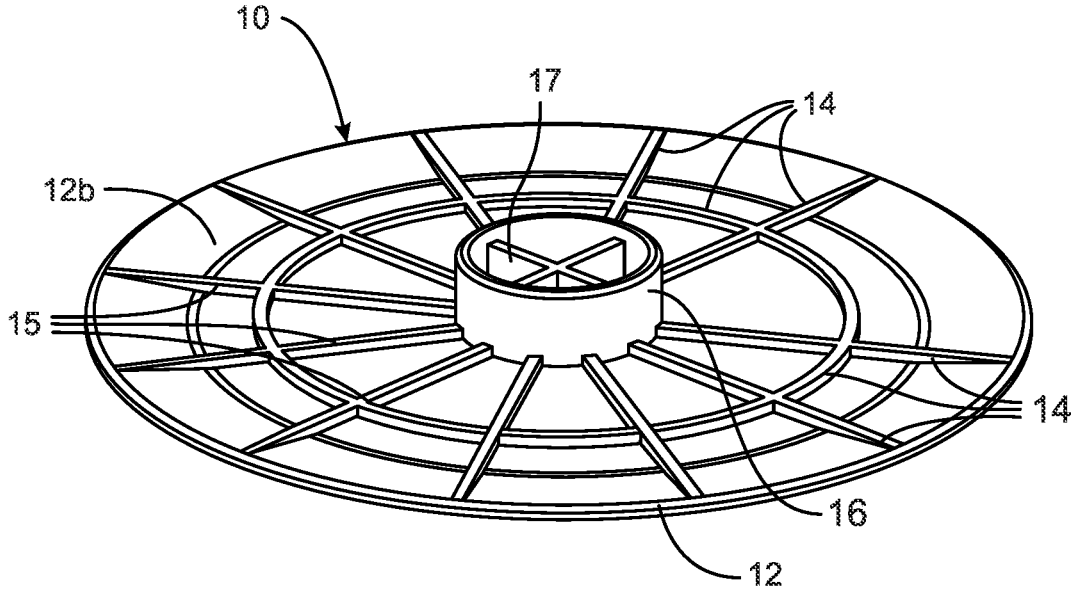
FIG. 1 is a top perspective view of the fitness slider according to one embodiment of the present disclosure
Figure 2:
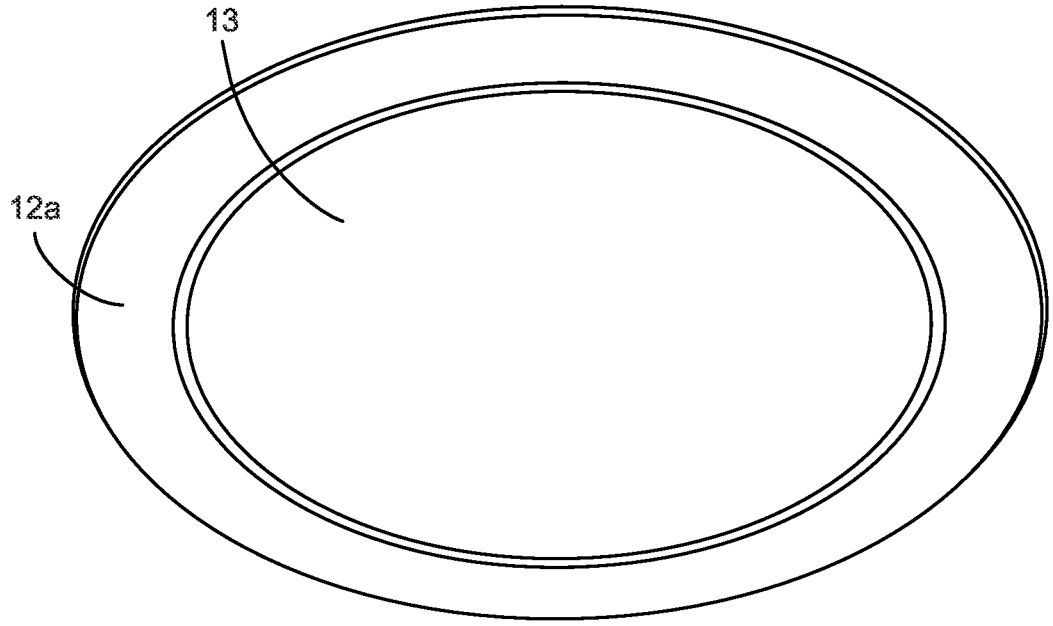
FIG. 2 is a bottom perspective view of the fitness slider shown in FIG. 1.

For the purposes of promoting an understanding of the principles of the disclosure, reference will now be made to the embodiments illustrated in the drawings and described in the following written specification. It is understood that no limitation to the scope of the disclosure is thereby intended. It is further understood that the present disclosure includes any alterations and modifications to the illustrated embodiments and includes further applications of the principles disclosed herein as would normally occur to one skilled in the art to which this disclosure pertains One embodiment of an exercise slider 10 is shown in FIGS. 1-4 that is capable of carrying a conventional weight plate. The slider includes a plate 12 that includes a generally planar sliding surface 13 formed of a low-friction material capable of easily sliding on a wide range of surfaces. The plate includes an angled rim 12*a* extending from the sliding surface. A plurality of reinforcement ribs 14 are provided on the upper face 12*b* of the plate in a pattern that prevents the plate from buckling or bending. In a preferred embodiment, the ribs 14 include a plurality of ribs that extend radially from the center hub 16 to the rim 12*a* and a plurality of rows of concentric circular ribs. The ribs define a support surface 15 on which the weight plate can rest.

The center hub 16 of the slider is a cylindrical collar sized to be received within the center opening of the weight plate. A center opening of a conventional weight plate has a diameter of two inches, so the diameter of the hub 16 is slightly less than two inches to provide a close fit within the center two-inch opening of one type of weight plate. It is contemplated that other hub diameters may be provided for weight plates having center opening diameters different from the conventional two-inch diameter, such as a one-inch opening that is common in lighter weight plates. The hub 16 has a height that is less than, but preferably about half, the thickness of the weight plate. In one specific embodiment, the hub has a height of one-half (½) inch from the support surface 15, which will accommodate the thickness of most weight plates W. Of course, the height of the hub can be adjusted to the thickness of the particular weight plate. The hub can be a solid cylinder, but is preferably hollow with reinforcement ribs 17 disposed within the interior of the hub.

Figure 3:
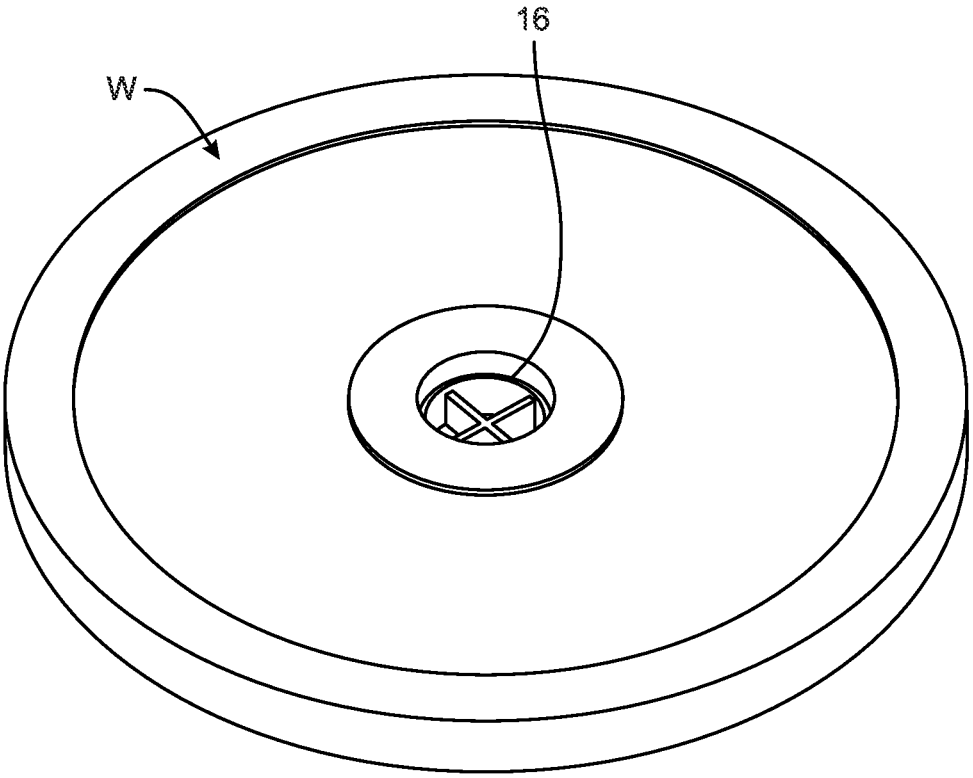
FIG. 3 is a top perspective view of the fitness slider of FIG. 1, shown carrying a weight plate.
Figure 4:
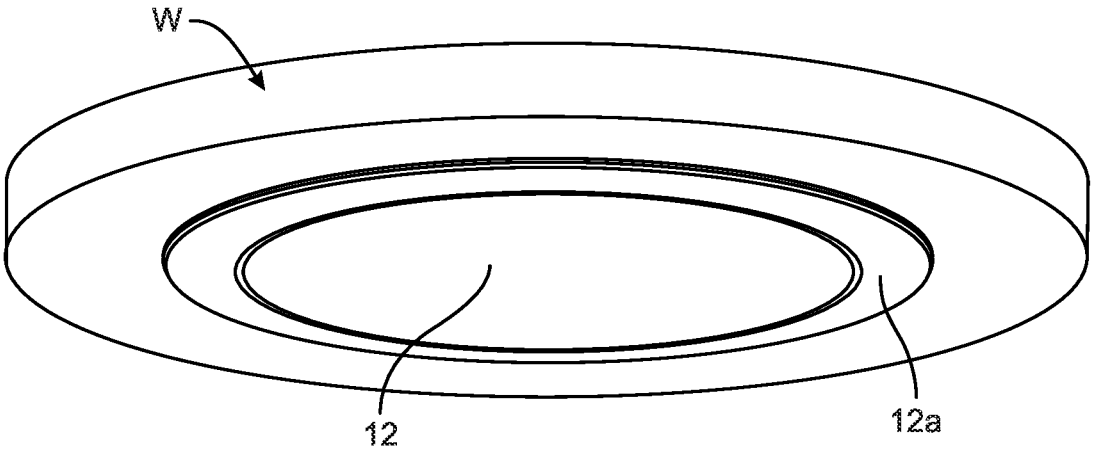
FIG. 4 is a top perspective view of the fitness slider of FIG. 2, shown carrying a weight plate.

In use, the weight plate W is mounted on the slider with the hub 16 fitting in the center opening of the plate, as shown in FIGS. 3-4. The user can then perform any of the wide array of slider/glider-based exercises. Instead of resting the hand or foot on the slider/glider, the user rests the foot or hand on the weight plate W itself. The weight of the plate and the pressure from the user's hand or foot will keep the weight plate firmly supported on the slider 10. As indicated above, the sliding surface 13 of the plate 12 can be substantially flat. However, the sliding surface can have a small amount of curvature in the unloaded configuration. The curvature is removed by the weight of the plate and the pressure from the user's hand/foot when in use.

The slider 10 is preferably molded in one piece, although it is contemplated that the center hub 16 can be separately fastened to the plate 12, such as by a threaded or snap-fit engagement. The slider can be made from a high-strength material that exhibits a low coefficient of friction. A preferred material is a plastic or resin, such as a polyamide (e.g., nylon), polycarbonate (e.g., BPA), polypropylene or polyethylene.

Figure 5:
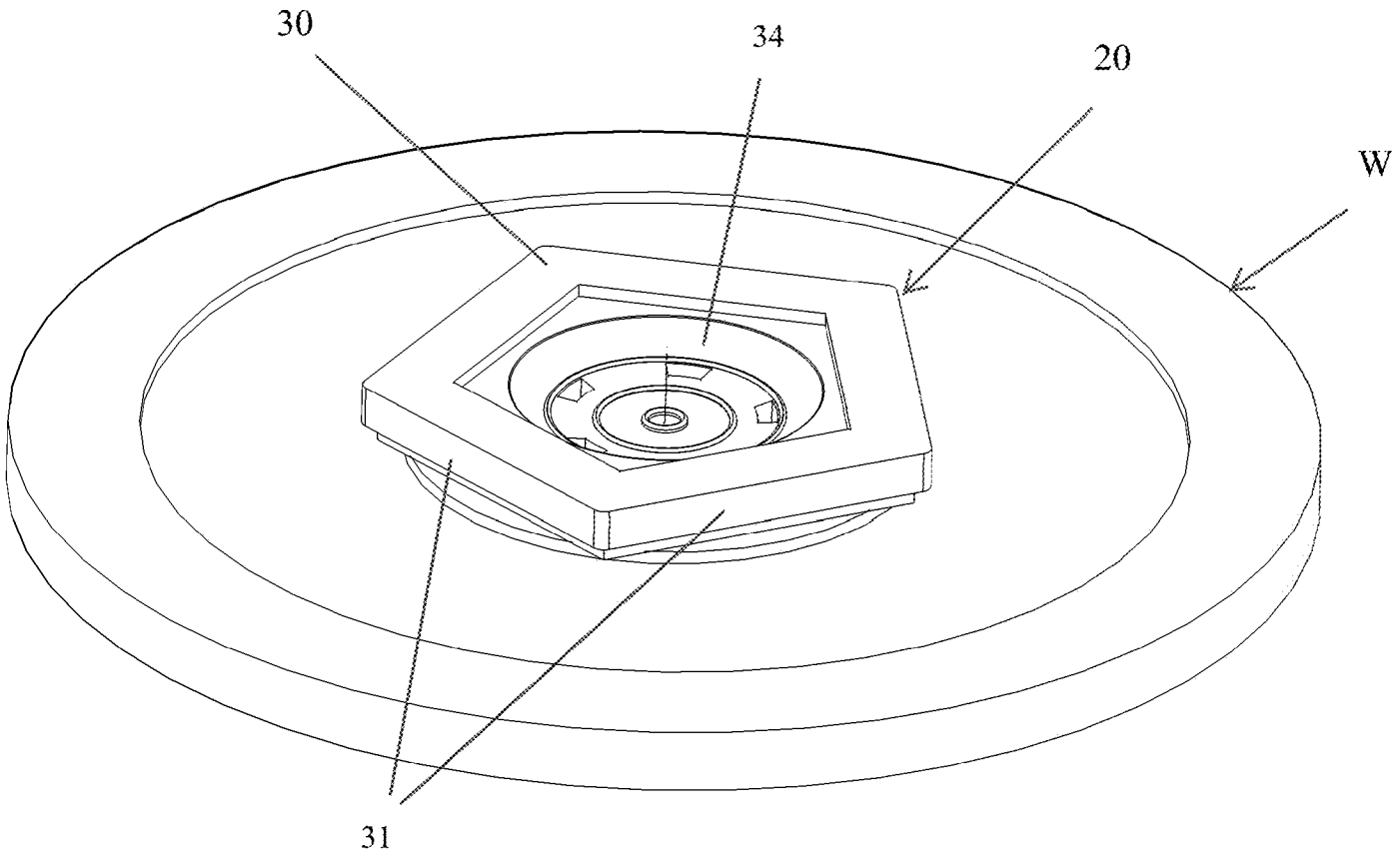
FIG. 5 is a top perspective view of a fitness slider according to another embodiment of the present disclosure, shown carrying a weight plate
Figure 6:
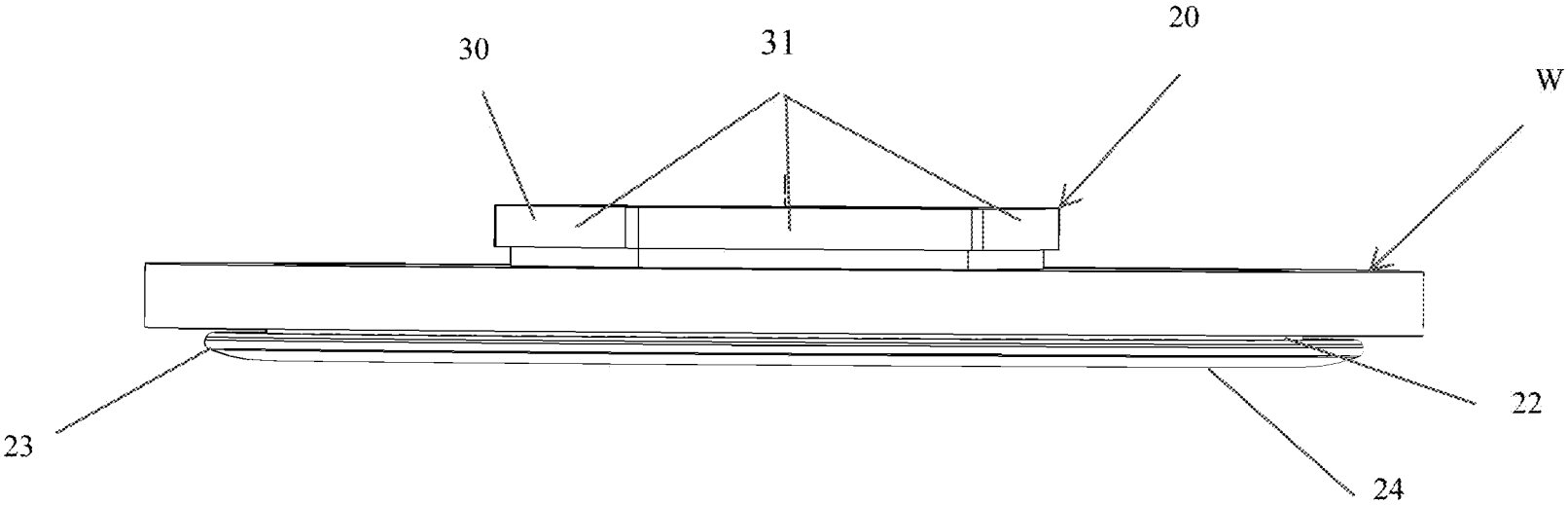
FIG. 6 is a side view of the fitness slider shown in FIG. 5.
Figure 7:
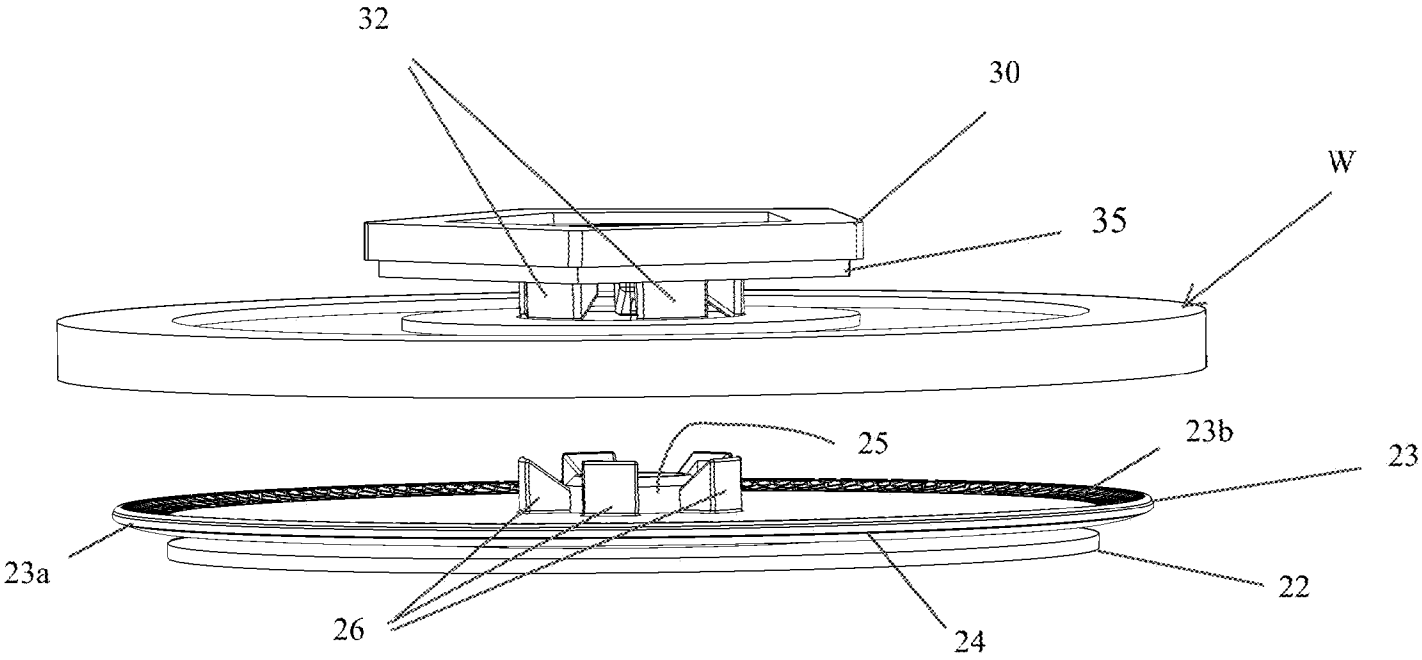
FIG. 7 is an exploded view of the fitness slider shown in FIG. 5.
Figure 8:
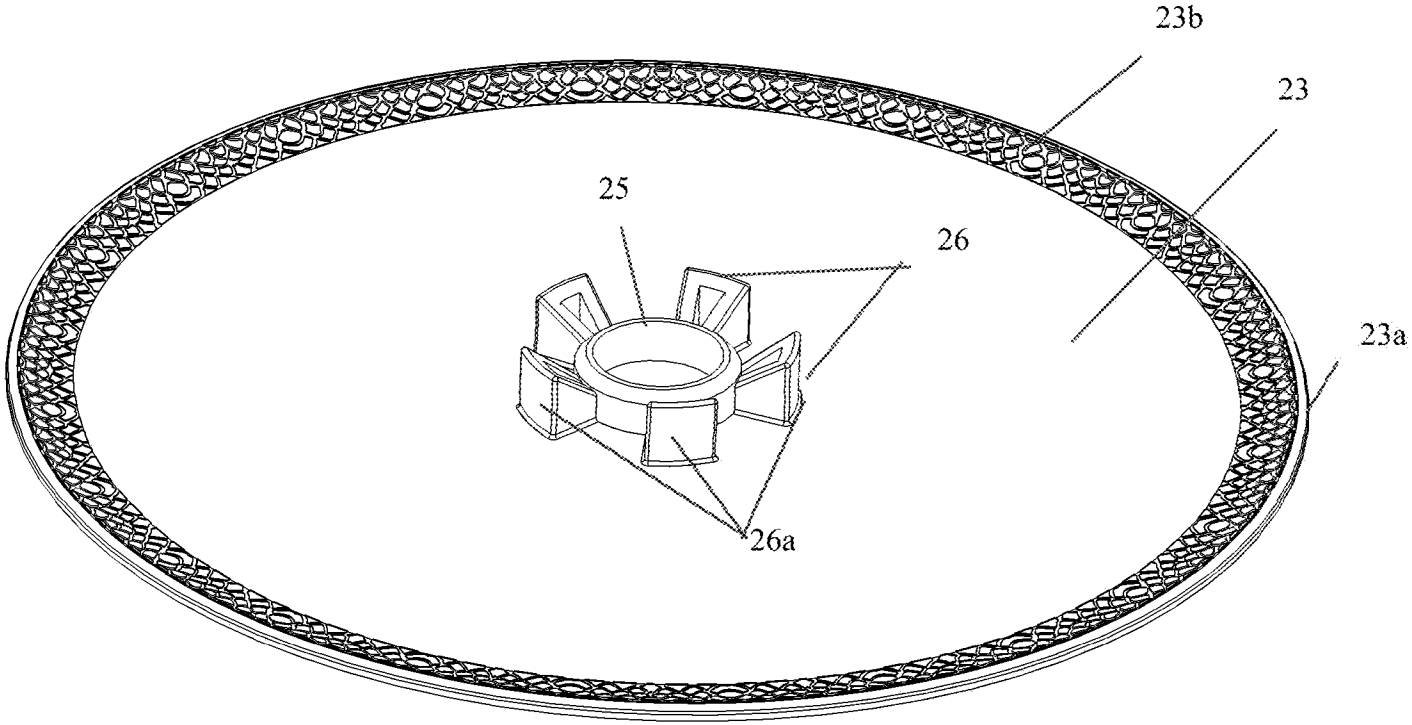
FIG. 8 is a top perspective view of a sliding plate of the fitness slider shown in FIG. 5.
Figure 9:
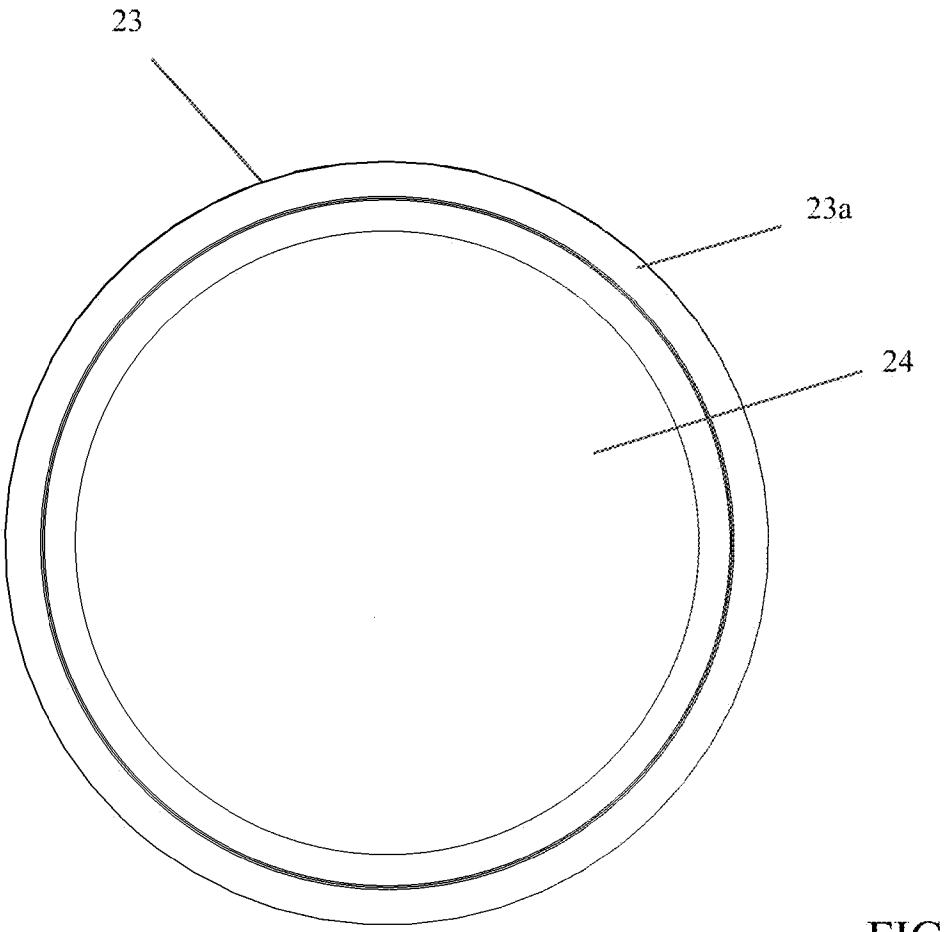
FIG. 9 is a bottom view of the sliding plate of FIG. 8.
Figure 10:
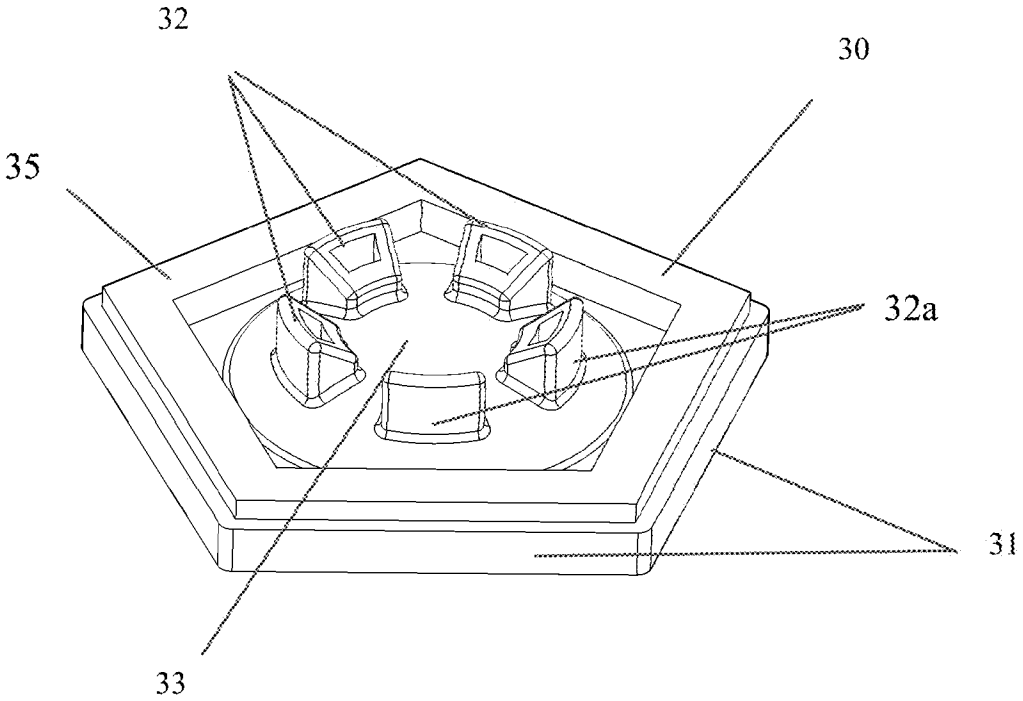
FIG. 10 is a top perspective view of a handle of the fitness slider shown in FIG. 5.

A slider 20 according to another embodiment is shown in FIGS. 5-12 in which the slider includes a handle 30 that can be engaged by the user's hand or foot during an exercise, rather than the weight plate as in the previous embodiment. As best seen in FIG. 6-7, the slider 20 includes a support plate 22 seated on a sliding plate 23. In one embodiment the support plate is separate from the sliding plate, while in another embodiment the support plate is integrally formed with the sliding plate. The sliding plate 23 defines the sliding surface 24 that provides the low-friction sliding contact with the floor or carpet. The sliding plate 23 can include an angled rim 23*a* and a reinforcement feature 23*b* at the upper face of the rim (see also FIG. 8). The support plate 22 provides a generally planar surface on which the weight plate W is stacked in use (see also FIGS. 12-13). It is contemplated that the slider 20 does not include the support plate 22, and instead that the weight plate W is seated on the angled rim 23*a* of the sliding plate 23. It can be appreciated that contact with the entire bottom surface of the weight plate is not necessary to support the plate when the fitness slider 20 is in use.

The sliding plate 23 includes an upwardly extending collar 25 and a plurality of engagement wedges 26 emanating radially from the collar. The support plate 22 includes a center opening 22*a* so that the support plate can be placed on the sliding plate 23 with the engagement wedges 26 projecting through the center opening. The outer faces 26*a* of the engagement wedges 26 are generally cylindrical and define an effective diameter that is slightly less than the diameter of the center opening of the weight plate W. Thus, for the conventional weight plate the center opening diameter is two inches, so the effective diameter of the outer faces 26*a* is slightly less than two inches to form a close-running fit with the weight plate. The engagement wedges 26 have a height that is less than the thickness of the weight plate, similar to the hub 16 of the slider 10 described above. Thus, in one specific embodiment, the wedges have a height of one inch for a 1.5-inch-thick weight plate. Lighter weight plates can have a thickness of about one inch so the engagement wedges can have a smaller height for a slider intended for use with the lighter weight.

Figure 12:
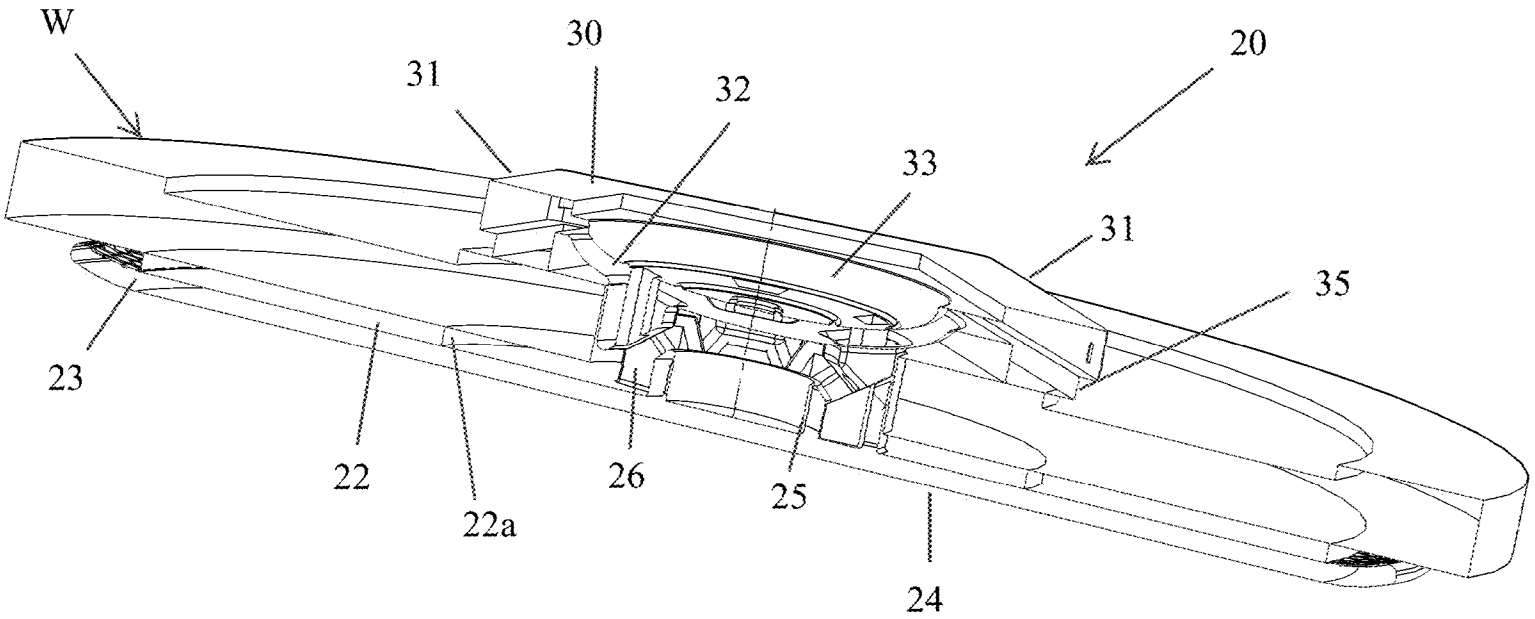
FIG. 12 is a side cross-sectional view of the fitness slider shown in FIG. 5.
Figure 13:
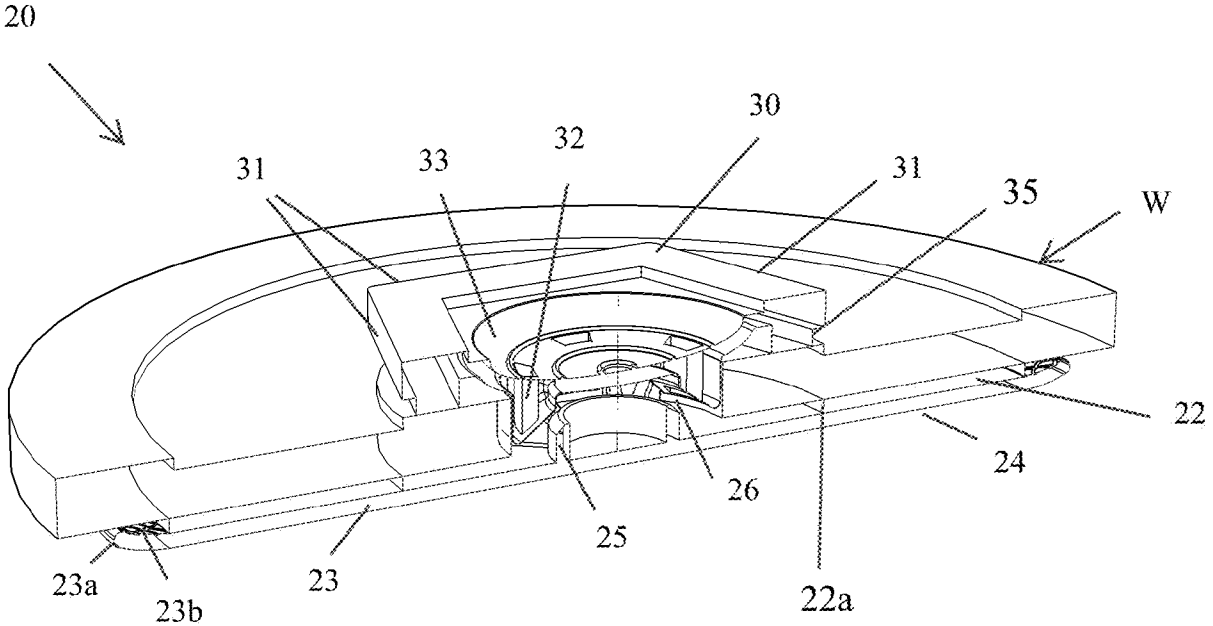
FIG. 13 is a further side cross-sectional view of the fitness slider shown in FIG. 5.

The handle 30 of the slider 20 includes a complementary plurality of engagement wedges 32 projecting from a boss 33 at the underside of the handle, as shown in FIG. 7, 10. The wedges 32 are substantially identical to the wedges 26 and are configured to be seated between adjacent ones of the wedges 26. The wedges 32 can have a height from the bottom face of the handle of about one inch, like the wedges 26. As with the wedges 26, the outer faces 32*a* of the wedges 32 are generally cylindrical and define an effective diameter that is slightly less than the diameter of the center opening of the weight plate W. In one specific embodiment, five wedges 26 and 32 are provided, spaced apart by 36°. Each wedge 26, 32 spans slightly less than 36° so that the two sets of wedges can form an interlocking engagement when the slider 20 is fully assembled, as shown in the cross-sectional views of FIGS. 12-13. The handle 30 includes a collar 35 that surrounds the wedges and is in contact with the top face of the weight plate, as shown in FIGS. 12-13. The collar 35 engages the surface of the weight plate W when pressure is applied to the handle 20 by the user.

Figure 11:
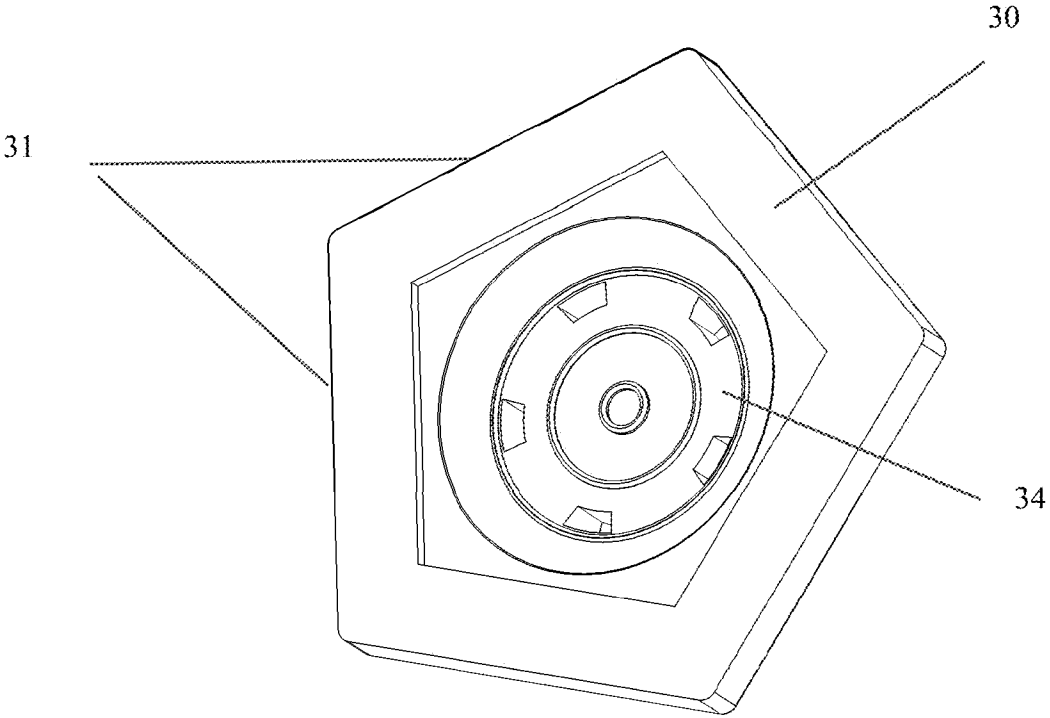
FIG. 11 is a bottom perspective view of the handle shown in FIG. 10.

The handle 30 can be circular, but in the embodiment of the present disclosure the handle is preferably non-circular. The handle thus includes a plurality of gripping sides 31 that can eb comfortably manually gripped by the user when performing an exercise. It has been found that a pentagonal handle 30 with five gripping sides 31 provides for optimal by the user. As shown in FIG. 6, the gripping sides 31 are offset from the top face of the weight plate W to provide clearance for the user's fingers when gripping the handle 30. The top of the handle 30 includes a recess 34, as shown in FIGS. 5 and 11. The recess is sized to receive the part of the foot of the user when performing exercises involving the user's legs.

As shown in the cross-sectional views of FIGS. 12-13, the weight plate W is sandwiched between the support plate 22 and the handle 30, with the support plate carried by the sliding plate 23. The user places the weight plate on the support plate 22 with the engagement wedges 26 projecting upward into the center opening of the weight plate. The handle 30 can then be introduced with the engagement wedges 32 projecting downward through the center opening of the weight plate. The handle can be manipulated so that the engagement wedges 32 of the handle interdigitate with the engagement wedges 26 of the sliding plate 23 within the center opening of the weight plate. It can be appreciated that no locking feature is needed to fix the handle to the sliding plate 23 because a downward force is always applied by the user's hand or foot when the fitness slider is in use. Even when the sliding plate is used to perform a burpee-type exercise (in which the slider is moved back and forth by the user's foot), there is still sufficient downward force to keep the handle engaged to the weight plate and sliding plate. The engagement wedges 32 are tall enough to span at least half of the depth of the center opening of the weight plate so that the handle cannot be dislodged by transverse force applied to the handle to slide the fitness slider back and forth across the floor. One benefit of the handle 30 is the safety measure provided by the removability of the handle from the sliding plate without also lifting the weight plate. More particularly, in this embodiment the handle is not connected or attached to the sliding plate so there is no risk that the user can attempt to lift the heavy weight plate by the handle.

Figure 14:
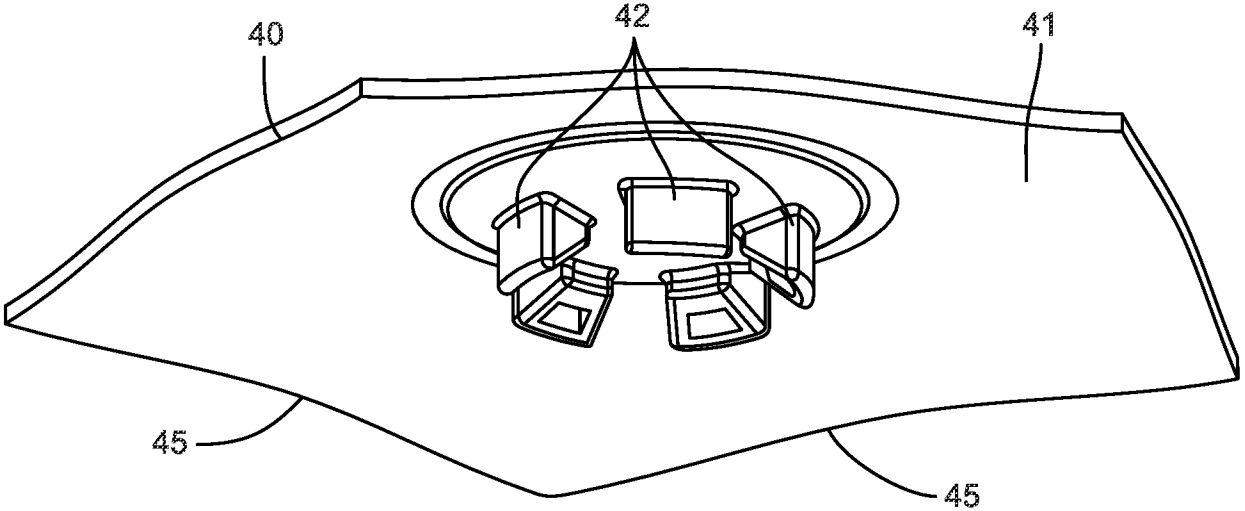
FIG. 14 is a bottom perspective view of another handle for use with the fitness slider shown in FIG. 5.
Figure 15:
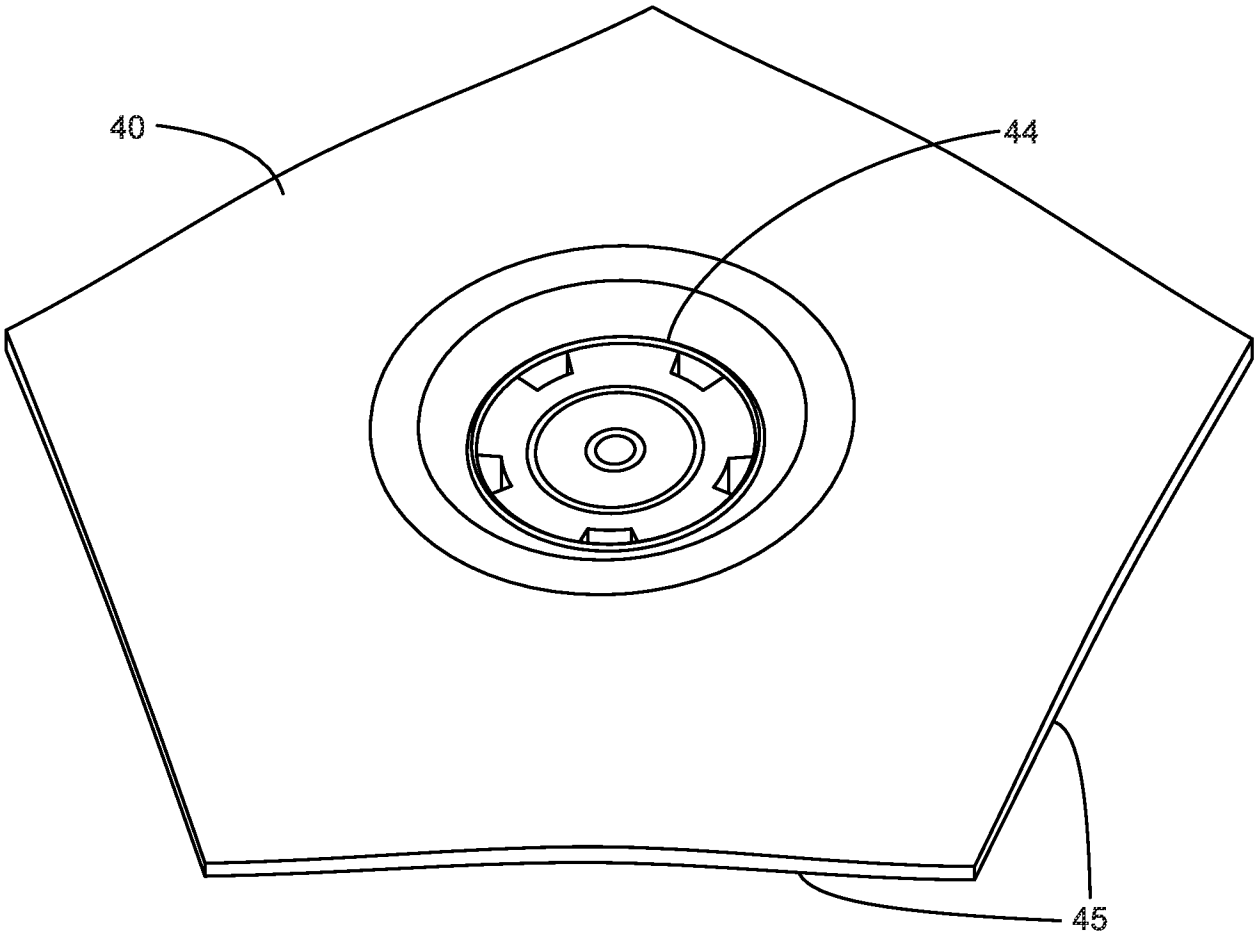
FIG. 15 is a top perspective view of the handle shown in FIG. 14.

In another embodiment, a handle 40, shown in FIGS. 14-15, is provided that can be used in lieu of the handle 30. The handle 40 includes a slightly dome-shaped plate 41 configured so that when the handle is initially placed on the weight plate only the edges 45 contact the weight plate W. Like the handle 20, the handle 40 includes engagement wedges 32 that are sized and arranged to interdigitate with the engagement wedges 26 of the sliding plate 23 (FIG. 8), in the same manner as the engagement wedges 32 of the handle 30 (FIGS. 12-13). The plat 41 defines a recess 44 that is similar in configuration and function to the recess 34 of the handle 30. The handle 40 is thus similar in overall configuration to the handle 30. However, the handle 40 does not incorporate the gripping sides 31 of the handle 30. Instead, the plate 41 of the handle 40 flexes as pressure is applied to the top face of the plate by the user's hand or foot. With this pressure, the dome-shape of the plate 41 flattens so that substantially the entire bottom surface of the plate 41 is in contact with the weight plate. Once it is engaged with the sliding plate 23 and weight plate W, the handle 40 functions in the same manner as the handle 30 to allow the user to slide the slider 20 across a surface during an exercise. The handle 40 can be formed of a suitably flexible material that can retain the dome-shape configuration, flatten under load, and then return to its dome-shape configuration when the load is removed. In some embodiments, the handle 40 can be formed of a polyvinylchloride (PVC) plastic, silicone or a rubber material.

Figure 16:
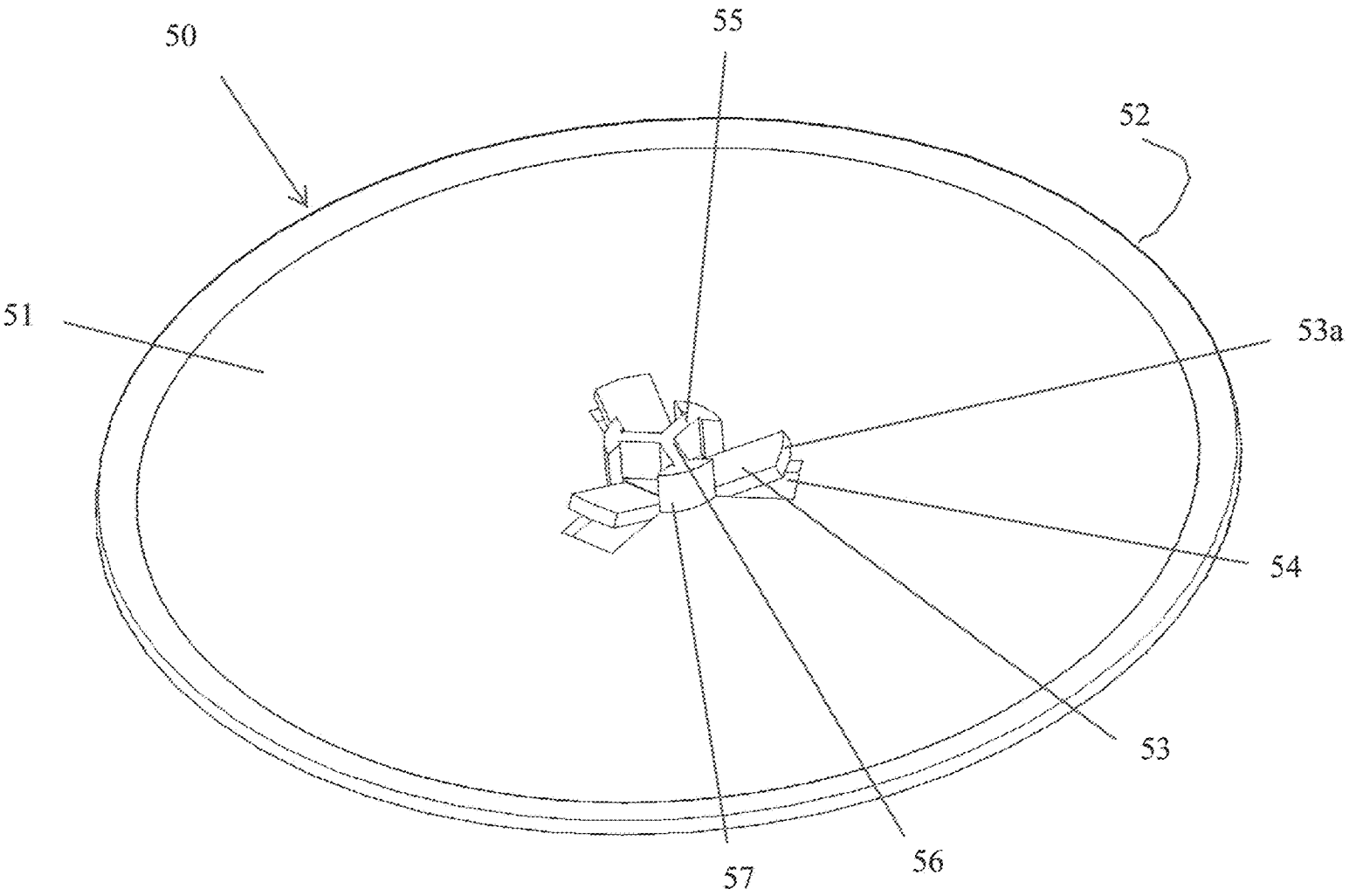
FIG. 16 is a top perspective view of a slider according to another embodiment of the present disclosure.
Figure 17:
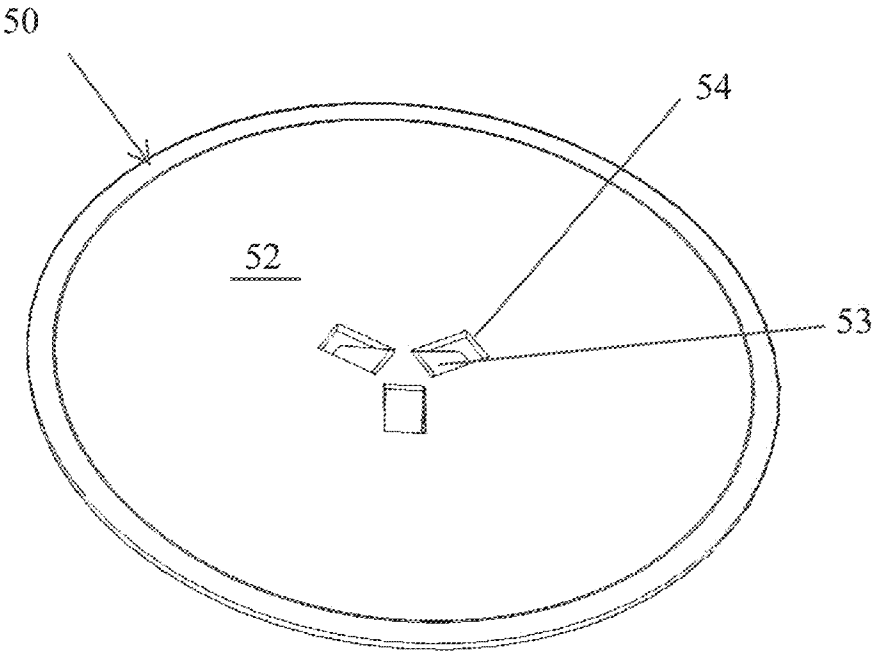
FIG. 17 is a bottom perspective view of the slider shown in FIG. 16.
Figure 18:
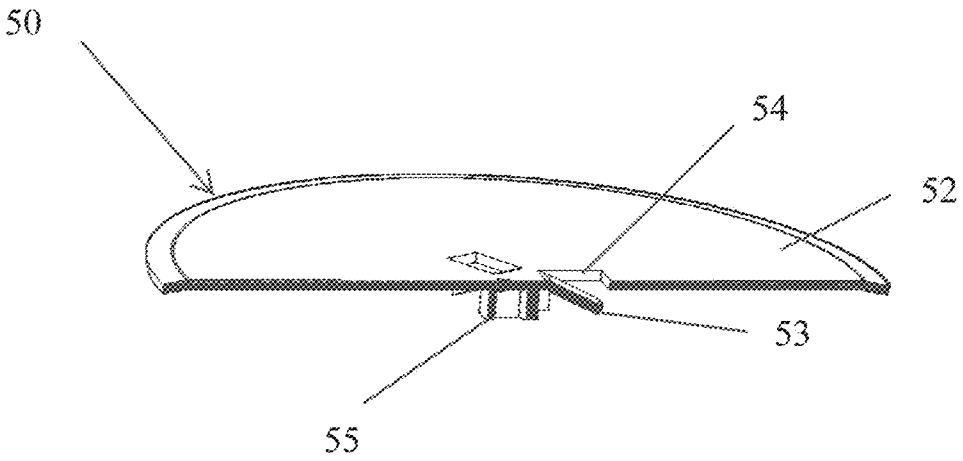
FIG. 18 is a side cross-sectional view of the slider shown in FIG. 16.
Figure 19:
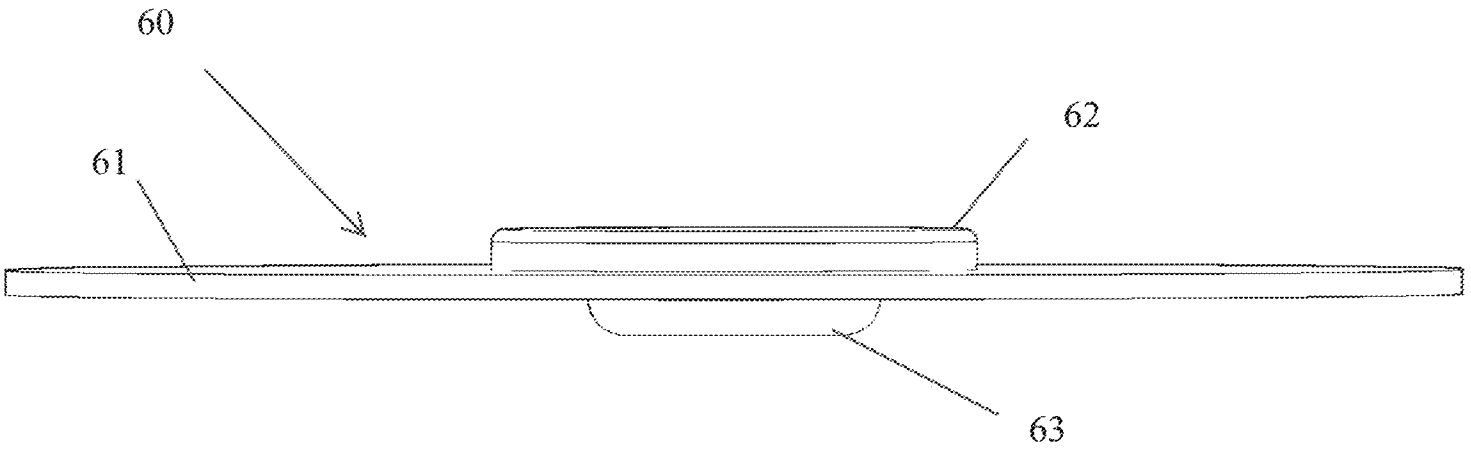
FIG. 19 is a side view of a handle according to another embodiment of the present disclosure.
Figure 20:
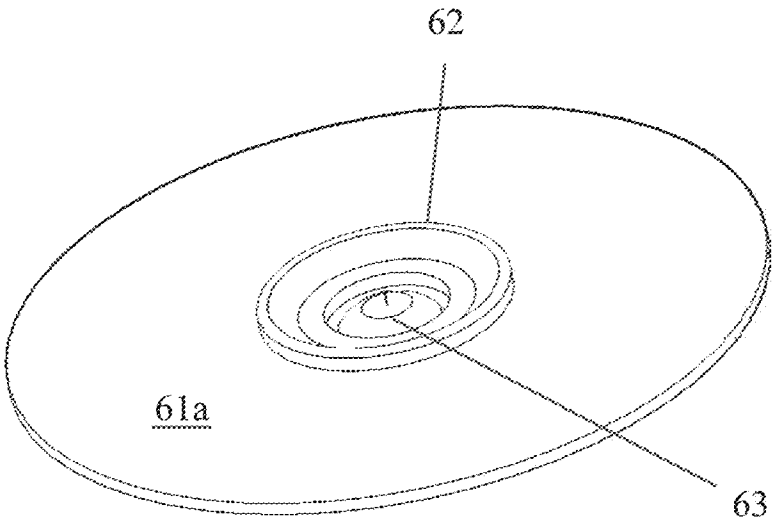
FIG. 20 is a perspective view of one side of the handle shown in FIG. 19.
Figure 21:
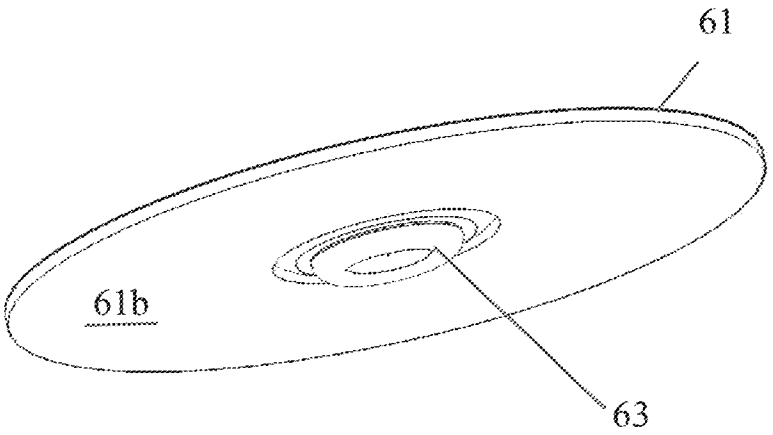
FIG. 21 is a perspective view of an opposite side of the handle shown in FIG. 19.

In another embodiment, a slider 50, shown in FIGS. 16-18, is configured to mate with weight plates having different center opening diameters. The slider 50 includes a plate 51 with a bottom surface 52 configured to slide on a surface. The center of the plate 51 includes mating elements configured to mate with a two-inch and a one-inch center opening in a weight plate. In particular, a plurality of spring arms 53 project upward from the plate 51. The outer edges 53*a* of the spring arms 53 define an effective diameter that is slightly less than two inches so that the arms can be received within a two-inch center opening of a weight plate. Three such spring arms are shown in FIG. 16, although more arms may be provided that are uniformly circumferentially distributed so that the outer edges define the effective diameter.

The spring arms 53 are configured to deflect downward toward the plate 51 under the weight of a weight plate placed on the slider. In particular, a weight plate having a center opening with a diameter smaller than the effective diameter of the outer edges 53*a* of the spring arms will bear against the spring arms to push them down. The spring arms 53 can be punched from the plate 51, leaving corresponding openings 54 beneath the spring arms. The openings 54 provide space for the spring arms 53 to deflect downward into the corresponding openings when the weight plate is in position. As the spring arms deflect downward, a center post 55 is exposed to engage the center opening of the weight plate. The center post 55 includes a plurality of wings 56 interspersed between the plurality of spring arms 53, as shown in FIG. 16. This configuration of the wings allows the spring arms to bend downward, allowing the wings to engage the weight plate opening. The wings 56 include flanges 57 at the end of the wings that define a circumferential surface that fits within the smaller center opening of a smaller weight plate. In particular, the flanges 57 can define an effective diameter that is slightly less than one inch to be received within a one-inch center opening of a smaller weight plate. It can thus be appreciated that the slider 50 is configured to accommodate two different sizes of weight plates.

Figure 22:
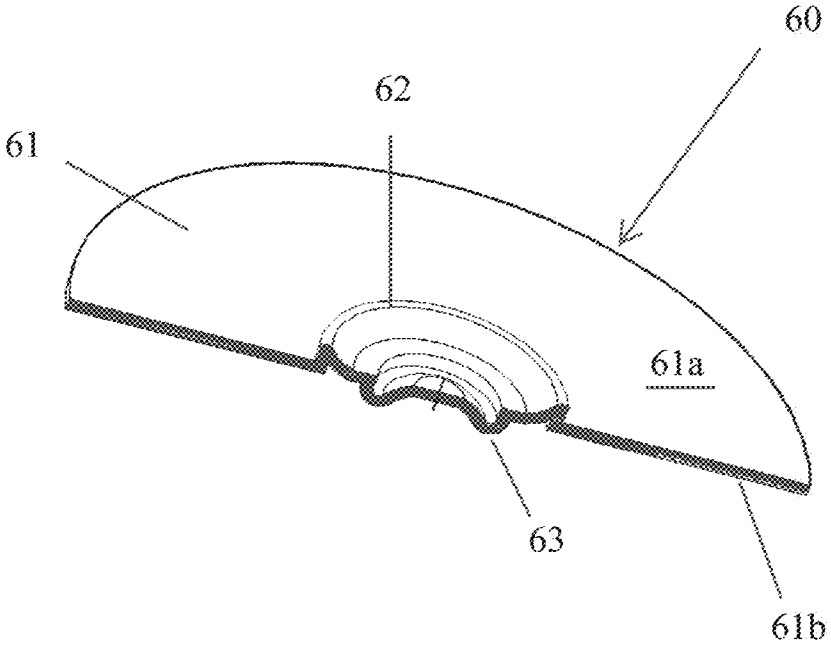
FIG. 22 is a side cross-sectional view of the handle shown in FIG. 19.

In a similar vein, a handle 60 can be provided as shown in FIGS. 19-22, that can be mounted on weight plates having different diameter center openings. The handle 60 includes a plate 61 with two opposite surfaces 61*a*, 61*b*, respectively. A collar 62 projects from the surface 61*a* that has a diameter configured to seat within the larger center opening of heavier weight plates. In particular, the collar 62 has a diameter slightly less than two inches. On the other side of the plate, a smaller hub 63 projects from the surface 61*b*. The smaller hub has a diameter configured to seat within the center opening of lighter weights. Thus, in one specific embodiment the hub 63 has a diameter of slightly less than one inch to seat within the center opening of the lighter weight. The collar 62 and hub 63 can be molded in complementary fashion within the plate 61, as shown in FIG. 22.

The components of the sliders 20, 50 are preferably molded in one piece, although it is contemplated that the engagement wedges 26, 32 of slider 20 or the spring arms 53 and hub 55 of the slider 50, can be separately fastened to the corresponding plate 23, 51 and handle 30, such as by a snap-fit engagement. The components of the sliders 20, 50 can be made from a high-strength material that exhibits a low coefficient of friction. A preferred material is a plastic or resin, such as a polyamide (e.g., nylon), polycarbonate (e.g., BPA), polypropylene or polyethylene. The sliding plate 22 is a thin plate, with a thickness of 0.25-0.50 inches. In some embodiments, the sliding plate can be slightly flexible.

The sliding plates 12, 23 of the sliders 10, 20 disclosed herein are preferably circular in configuration, with an outer diameter sufficiently large to support a large weight plate while still maintaining low-friction contact with the floor or carpet. A conventional 25-pound weight has a diameter of 12 inches, while the larger 45-pound weight has a diameter of about 17 inches. Thus, in a preferred embodiment, the sliding plates 12, 23 have a diameter of ten inches. This diameter sufficiently supports the weight plate while minimizing the frictional surface area of the slider. Of course, smaller weight plates with smaller diameters will also fit on the sliders 10, 20 disclosed herein. However, it is understood that smaller sliding plates can be provided for smaller weight plates, such as at diameters of five-six inches.

The present disclosure should be considered as illustrative and not restrictive in character. It is understood that only certain embodiments have been presented and that all changes, modifications and further applications that come within the spirit of the disclosure are desired to be protected.

What is claimed is:

1. A fitness slider comprising:

a sliding plate in the form of a circular disc having a sliding surface on one side of the sliding plate and the opposite side of the sliding plate configured to support a weight plate;

a center hub integrally formed with and projecting from said opposite side of the sliding plate, said center hub sized and configured to be received within a center opening of the weight plate when the weight plate is supported on the sliding plate; and a plurality of reinforcement ribs integrally formed with said opposite side of the sliding plate and extending radially from said center hub, said reinforcement ribs defining a support surface for supporting the weight plate.

2. The fitness slider of claim 1, wherein said sliding plate includes an angled rim surrounding said sliding surface.

3. The fitness slider of claim 1, wherein said center hub has a height from said opposite side of said sliding plate that is less than the thickness of the weight plate supported therein.

4. The fitness slider of claim 3, wherein said height is about one inch.

5. The fitness slider of claim 1, wherein said sliding plate and said center hub are integrally formed together.

6. The fitness slider of claim 5, wherein said sliding plate and said center hub are formed of a plastic or resin.

7. The fitness slider of claim 6, wherein said sliding plate and said center hub are formed of a material selected from the group including a polyamide, a polycarbonate, a polypropylene and a polyethylene.

8. The fitness slider of claim 1, further comprising:

a plurality of spring arms projecting from said opposite side of the sliding plate, said plurality of spring arms having outer edges defining a first diameter sized to be received with the center opening of a first weight plate, wherein the center hub defines a second diameter smaller than said first diameter and sized to be received within the center opening of a second weight plate that is smaller than the center opening of the first weight plate, and wherein said spring arms are configured to deflect under the weight of the second weight plate to allow the center hub to be received within the center opening of the second weight plate.

9. A fitness slider, comprising:

a sliding plate having a sliding surface on one side of the sliding plate and the opposite side of the sliding plate configured to support a weight plate therein; and a center hub projecting from said opposite side of the sliding plate, said center hub sized and configured to be received within a center opening of the weight plate when the weight plate is supported on the sliding plate, wherein said center hub is a cylindrical collar and includes reinforcement ribs inside the collar.

10. A fitness slider comprising:

a sliding plate having a sliding surface on one side of the sliding plate and the opposite side of the sliding plate configured to support a weight plate therein;

a plurality of first engagement wedges projecting from said opposite side of the sliding plate, said plurality of first engagement wedges sized and arranged to extend through a center opening of the weight plate when the weight plate is supported on said sliding plate;

a handle configured to be seated on the weight plate supported on the sliding plate and for engagement by the hand or foot of a user; and a plurality of second engagement wedges projecting from said handle, said plurality of second engagement wedges sized and arranged to extend through the center opening of the weight plate and to interdigitate with said plurality of first engagement wedges within the center opening of the weight plate.

11. The fitness slider of claim 10, further comprising a support plate supported on said opposite side of said sliding plate and defining an opening for receiving said plurality of first engagement wedges therethrough, wherein the weight plate is supported on said support plate.

12. The fitness slider of claim 10, wherein said plurality of first engagement wedges and said plurality of second engagement wedges each include five engagement wedges.

13. The fitness slider of claim 12, wherein said plurality of first engagement wedges are evenly angularly spaced on said sliding plate and said plurality of second engagement wedges are evenly angularly spaced on said handle.

14. The fitness slider of claim 10, wherein said plurality of first engagement wedges and said plurality of second engagement wedges have a height of about one inch.

15. The fitness slider of claim 10, wherein said handle includes a plurality of sides configured for manual engagement.

16. The fitness slider of claim 10, wherein said handle includes a dome-shaped plate that is formed of a material configured to allow the dome-shaped plate to be compressed against the weight plate when engaged by the hand or foot of the user.

17. The fitness slider of claim 10, wherein said handle includes five sides.

18. The fitness slider of claim 10, wherein said handle defines a recess in an upper surface configured to receive a portion of the foot of a user.

19. The fitness slider of claim 10, wherein said sliding plate is formed of a material selected from the group including a polyamide, a polycarbonate, a polypropylene and a polyethylene.

* * * * *